United States Patent [19]

Wilson

[11] 4,252,187

[45] Feb. 24, 1981

[54] BEARING-EQUIPPED WELL TOOL

[75] Inventor: Michael L. Wilson, Houston, Tex.

[73] Assignee: Armco Inc., Middletown, Ohio

[21] Appl. No.: 36,660

[22] Filed: May 7, 1979

[51] Int. Cl.[3] ..... E21B 33/035

[52] U.S. Cl. ..... 166/115; 166/89; 285/272

[58] Field of Search ..... 166/313, 85, 89, 208, 166/115; 285/272, 275, 276, 277

[56] References Cited

U.S. PATENT DOCUMENTS

| | | | |
|---|---|---|---|
| 2,778,433 | 1/1957 | Brown | 285/66 |
| 3,540,533 | 11/1970 | Morrill | 166/344 |
| 3,761,117 | 9/1973 | Shendane | 285/277 |

*Primary Examiner*—James A. Leppink

*Attorney, Agent, or Firm*—Roylance, Abrams, Berdo & Farley

[57] ABSTRACT

Well tools which must be rotated after landing are equipped with an antifriction bearing in such fashion that the tool is supported through the bearing initially and then supported via solid metal-to-metal contact which bypasses the bearing.

4 Claims, 25 Drawing Figures

10
14
15
16
17
18
19
20
21
22
23
24
25
26
27
28
29
30
31
32
33
40
41
43
44
45
46
47
48
49
50
51
52
53
54
55
56
57
58
59
60
61
62
63
64
65
66
67
68
69
70
3

BEARING-EQUIPPED WELL TOOL

RELATED APPLICATIONS

Subject matter disclosed herein is disclosed and claimed in copending application Serial No. 36,658 filed concurrently herewith by Kerry G. Kirkland and application Ser. No. 36,659 filed concurrently herewith by Michael L. Wilson.

BACKGROUND OF THE INVENTION

Well tools, and particularly multiple string tubing hangers which must be rotated for orientation after landing, have frequently been provided with ball bearings or like antifriction bearing means to provide ease of rotation via, e.g., a handling string. Bearing-equipped well tools according to the prior art are shown, for example, in the following U.S. Pat. Nos.:

2,778,433: Brown,
3,688,841: Baugh,
3,693,714: Baugh,

Heretofore, such well tools have been so constructed that the weight applied to the tool is supported through the antifriction bearing either directly, as in the structures shown in the Baugh patents, or through the series combination of the bearing and a packing or seal structure. While prior-art tools of this type have achieved considerable acceptance, there has been a continuing need to improve the freedom of rotation provided and to improve the capability of the tools to support very heavy loads as, for example, in the case of a tubing hanger supporting long tubing strings.

OBJECTS OF THE INVENTION

A general object of the invention is to devise a well tool providing a high degree of freedom of rotation when landed but also operative to support large loads by metal members in direct metal-to-metal contact.

Another object is to provide such a tool which includes a pressure energized seal device but maintains the seal device is an unenergized low friction condition until after rotational adjustment of the tool has been completed.

A further object is to provide such a tool which is relatively simple and inexpensive, yet affords greater freedom of rotation and better load carrying capabilities.

SUMMARY OF THE INVENTION

Generally stated, well tools according to the invention comprise antifrication bearing means, typically a ball bearing, comprising upper and lower annular race members and antifriction elements disposed therebetween, the upper race member surrounding the well tool and being initially held in a first position by shear means, the lower race having both a support shoulder to be engaged with a shoulder presented by the member on which the tool is to be landed, and an inwardly directed flange spaced below a downwardly facing support shoulder on the tool when the upper race member is in its first position. When the tool is first landed, the tool is supported via the bearing, and in the case of a tubing hanger, a major part of the weight is supported by the handling string. After rotational adjustment has been achieved, the full weight is applied to the tool, shearing the shear means, and causing the tool to move downwardly through the bearing means until the downwardly facing shoulder of the tool engages the flange of the lower race member so that the tool is then supported directly through metal members and the bearing is bypassed. The tool is advantageously equipped with a pressure energizable sealing ring disposed above the bearing means in such fashion that the sealing ring is relaxed and underformed when the upper race member is in its first position, so that the sealing ring generates minimum frictional forces to resist rotation of the tool. Downward movement of the tool through the bearing means energizes the sealing ring.

IDENTIFICATION OF THE DRAWINGS

In order that the manner in which the foregoing and other objects are achieved according to the invention can be understood in detail, one particularly advantageous embodiment thereof will be described with reference to the accompanying drawings, which form part of the original disclosure of this application, and wherein.

Figure 18:
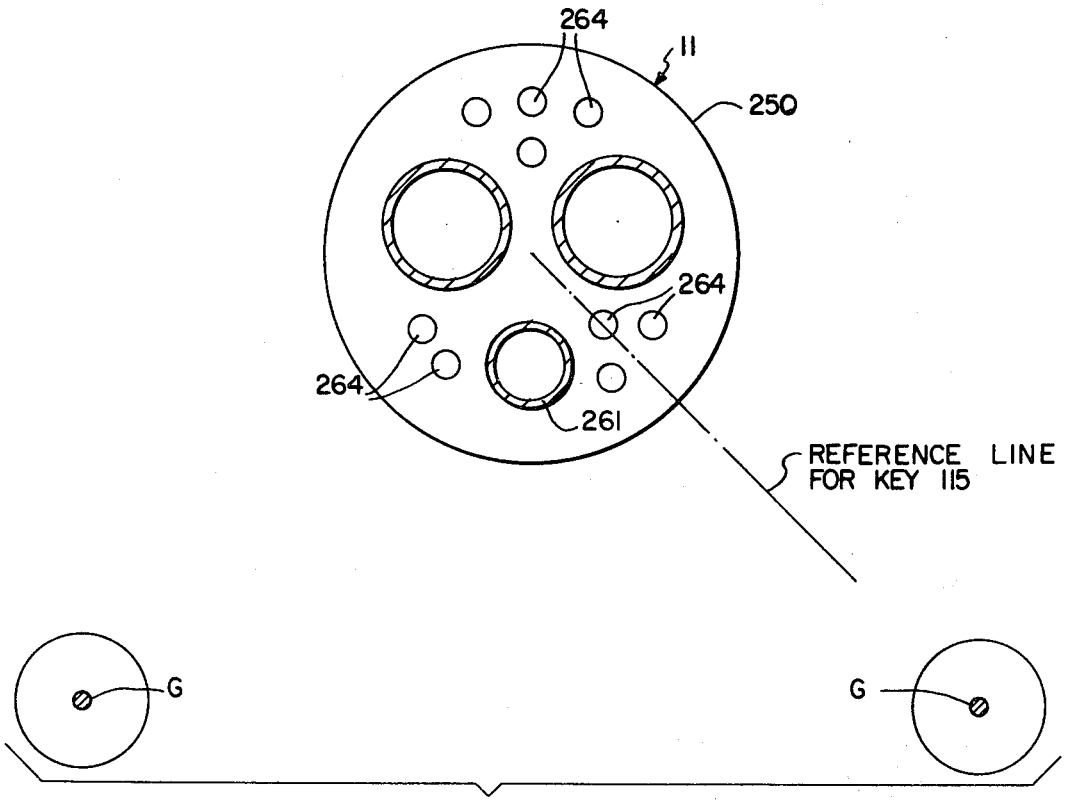
Figure 17:
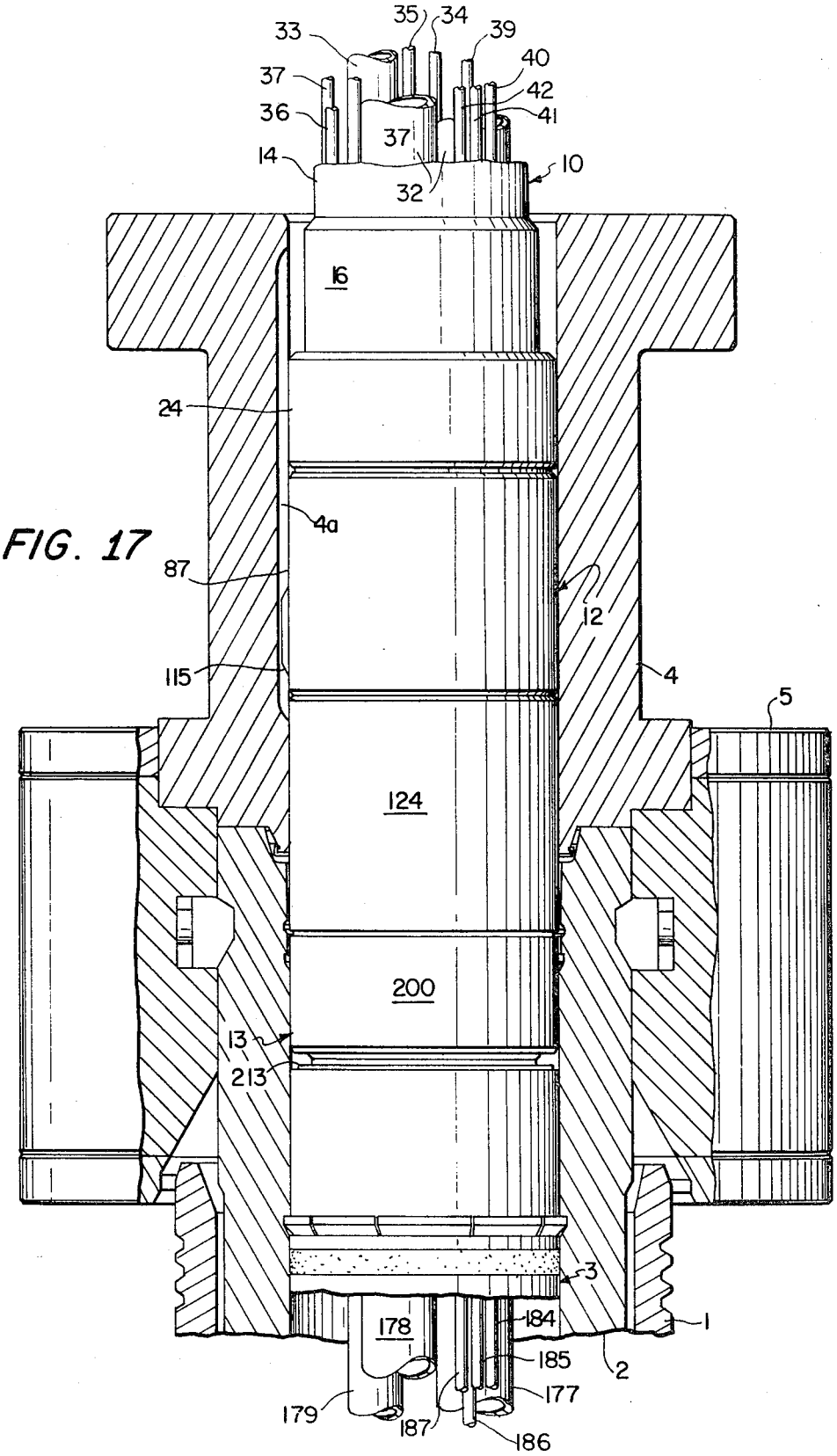
Figure 17A:
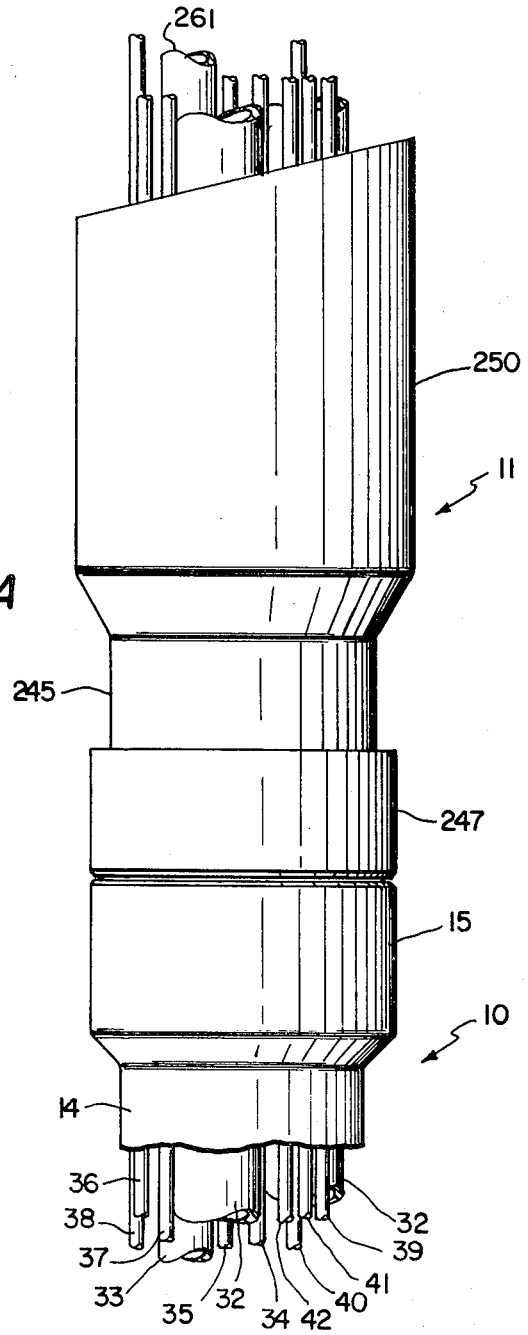

FIGS. 17 and 17A are views, partly in longitudinal cross section and partly in side elevation, showing the wellhead apparatus, with blowout preventers omitted for clarity, with the composite handling joint, multifunction tool, and tubing hanger in place after landing of the tubing hanger; and FIG. 18 is a diagram showing the relative position of various parts of the apparatus with respect to the guidance system.

DETAILED DESCRIPTION OF THE INVENTION

While the invention is applicable to all well tools which are to be rotationally adjusted after landing, it will be described with reference to a multiple string tubing hanger installed in an underwater well installation in accordance with the method disclosed in the aformentioned copending application Serial No. (Case A), with the aid of a conventional guidance system such as that disclosed in U.S. Pat. No. 2,808,229, issued Oct. 1, 1957, to Bauer et al.

Figure 1:
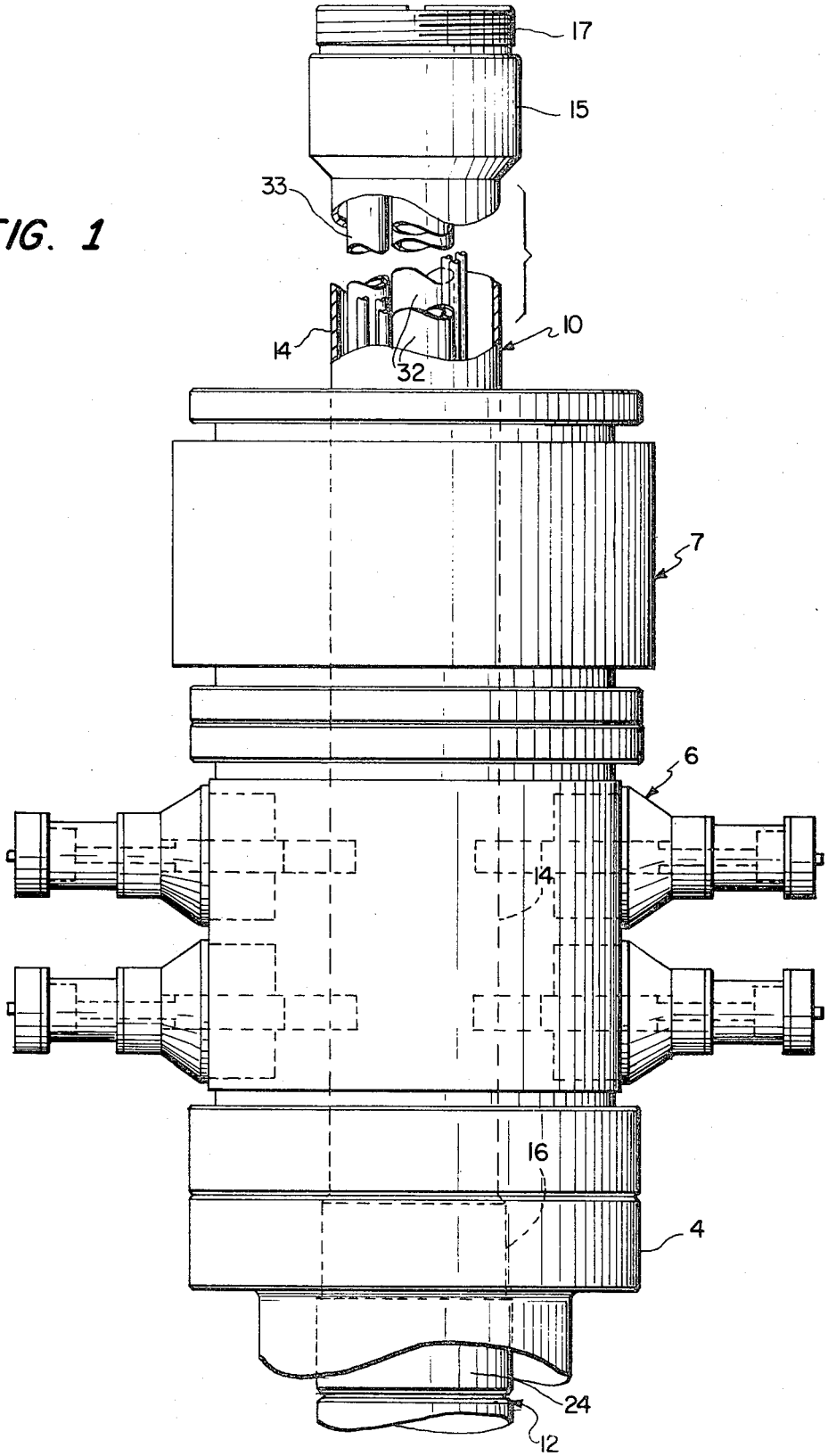
FIG. 1 is a side elevational view, with some parts broken away for clarity, of a portion of an underwater wellhead, including blowout preventers, showing a composite handling joint extending through the blowout preventers.

The well installation can comprise an outer casing 1 which supports a wellhead body 2 from which the inner casing (not shown) is suspended by casing hanger means including the casing hanger packoff device indicated generally at 3. The wellhead comprises an upper body 4 seated on body 2 and secured thereto by a conventional remotely operated connector 5 which can be of the type described in U.S. Pat. No. 3,228,715 issued Jan. 11, 1966, to Neilon et al. As seen in FIG. 1, upper body 4 supports the blowout preventer stack comprising a dual ram preventer 6 and, for redundancy, a bag preventer 7, the two preventers being sized as later described but being otherwise conventional. Upper body 4 has a longitudinally extending inwardly opening locator slot 4*a* and, installed with the aid of a guidance system, is so positioned that slot 4*a* occupies a predetermined rotational position.

Figure 7:
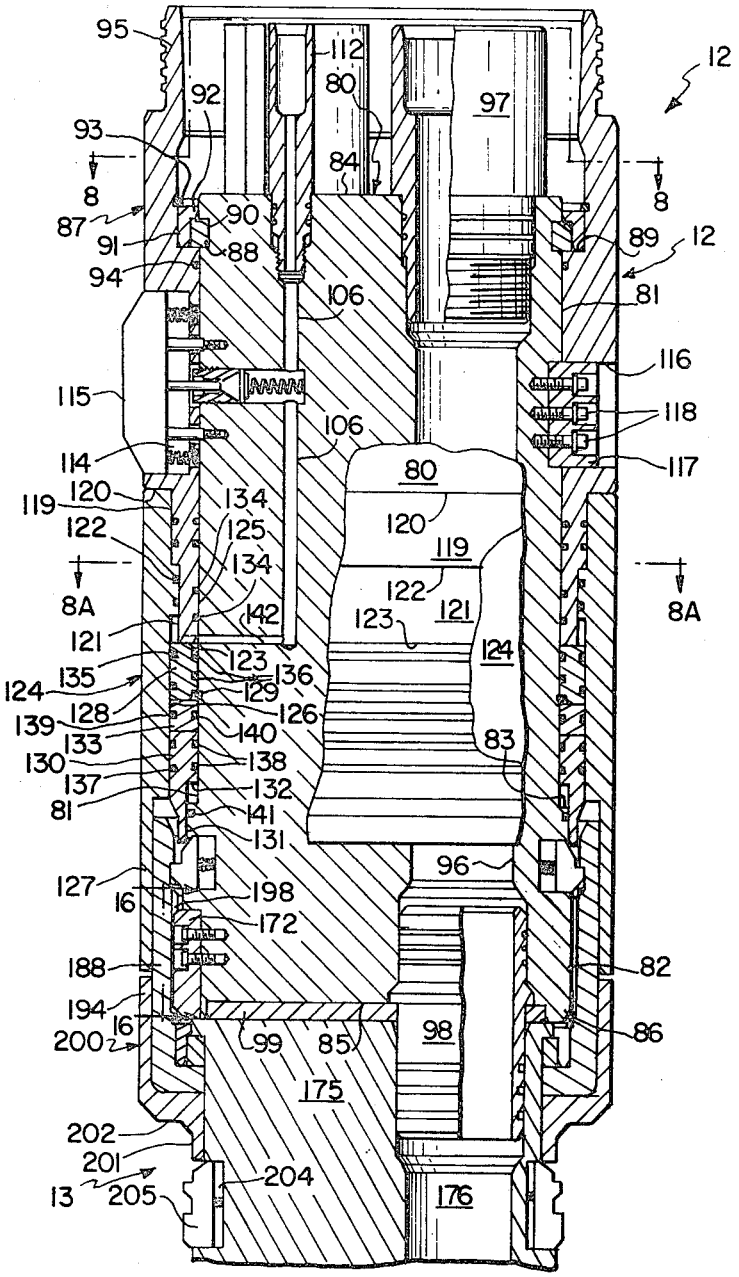
FIG. 7 is a longitudinal sectional view taken generally on line 7—7, FIG. 8, of a multipurpose handling tool according to the invention, with a multiple string tubing carried thereby.
Figure 8:
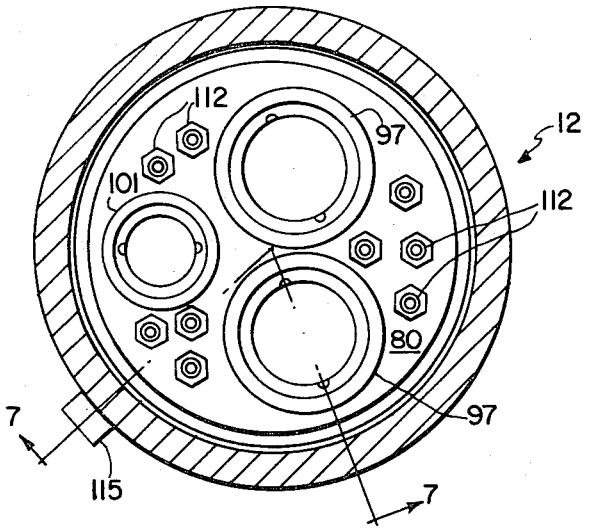
FIG. 8 is a transverse sectional view taken generally on line 8—8, FIG. 7.
Figure 8A:
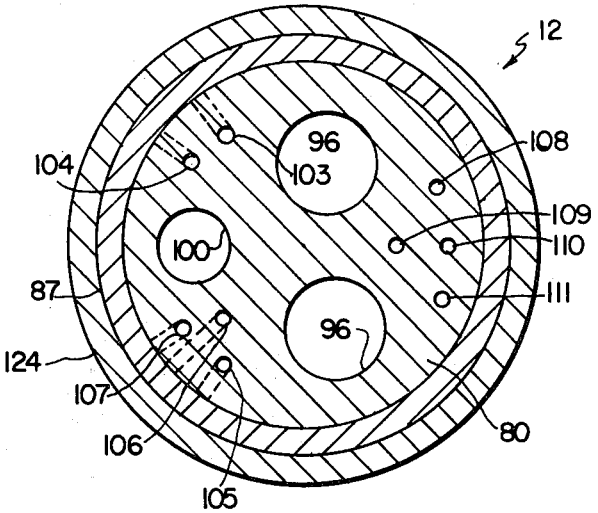
FIG. 8A is a transverse sectional view taken on line 8A—8A, FIG. 7.
Figure 8B:
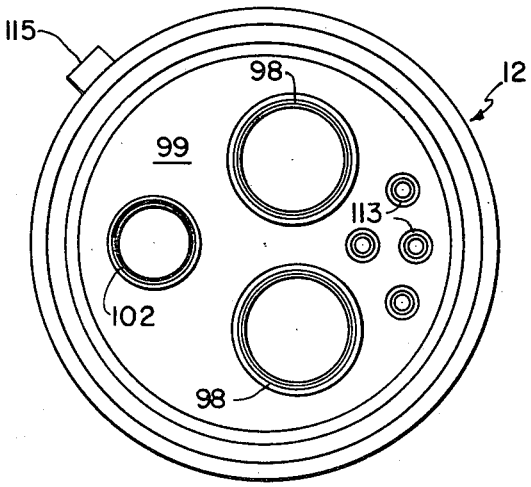
FIG. 8B is a bottom plan view of the tool of FIGS. 7-8A.
Figure 13:
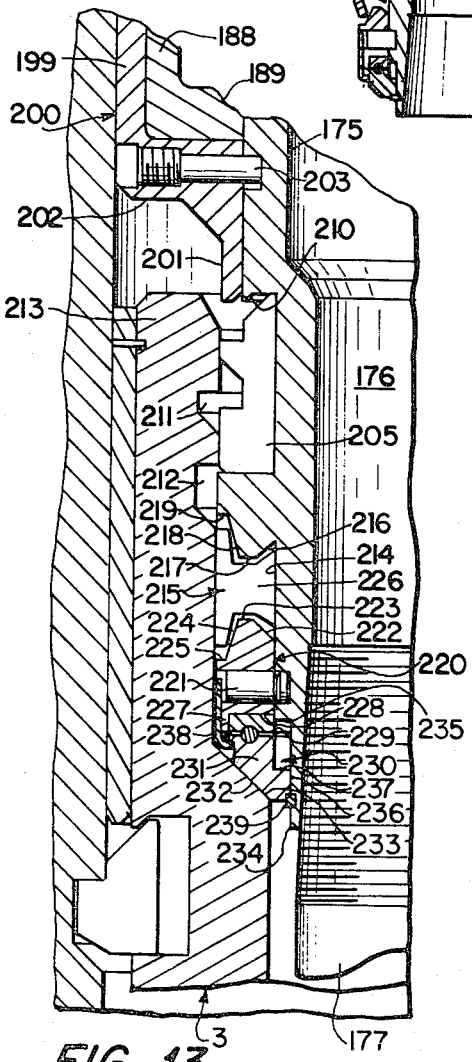
FIGS. 13 and 14 are fragmentary longitudinal sectional views, enlarged with respect to FIG. 11, showing parts of the tubing hanger in different operative positions.
Figure 14:
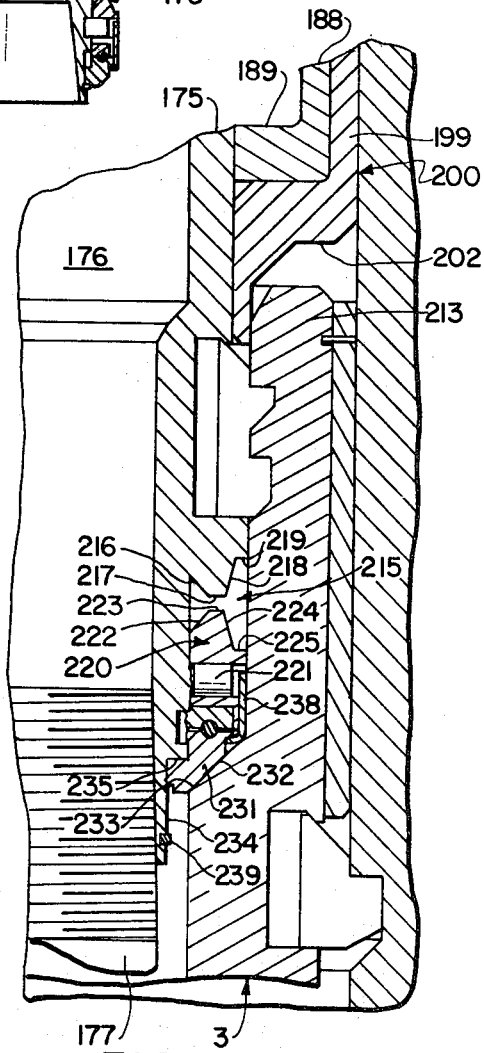
Figure 15:
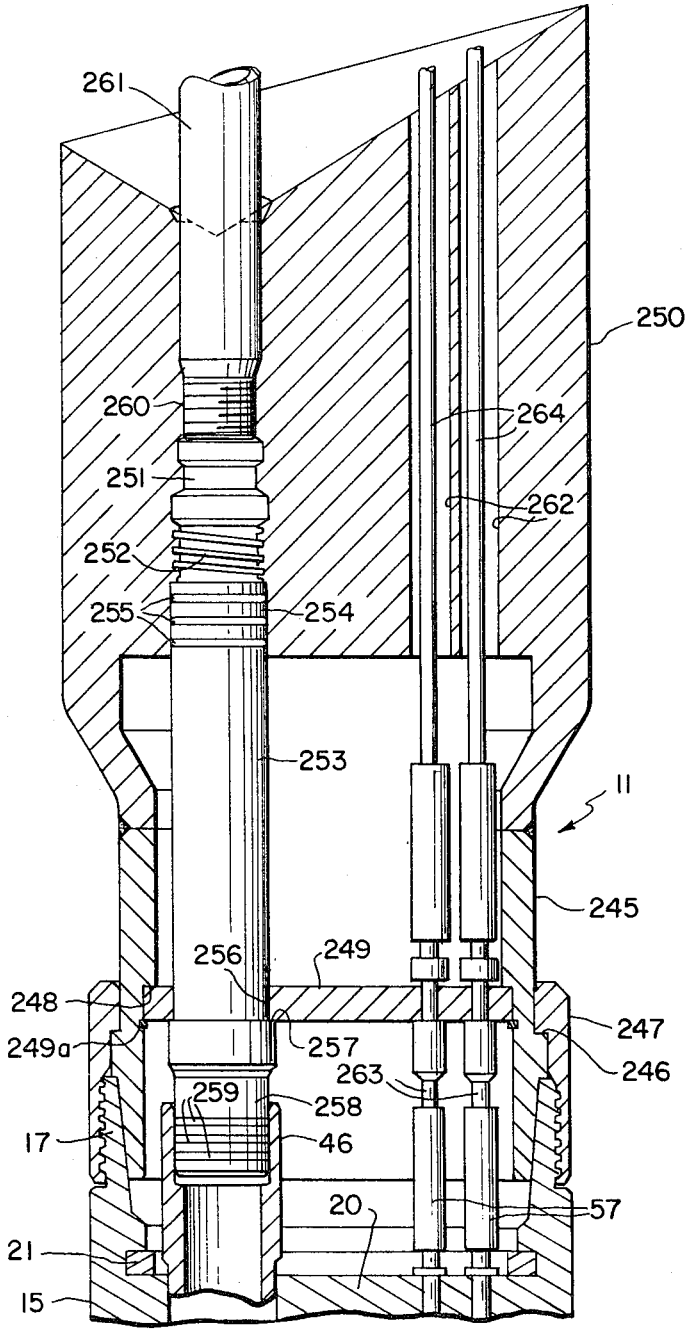
FIG. 15 is a longitudinal sectional view of a top closure body for the handling joint of FIGS. 2–7.
Figure 16:
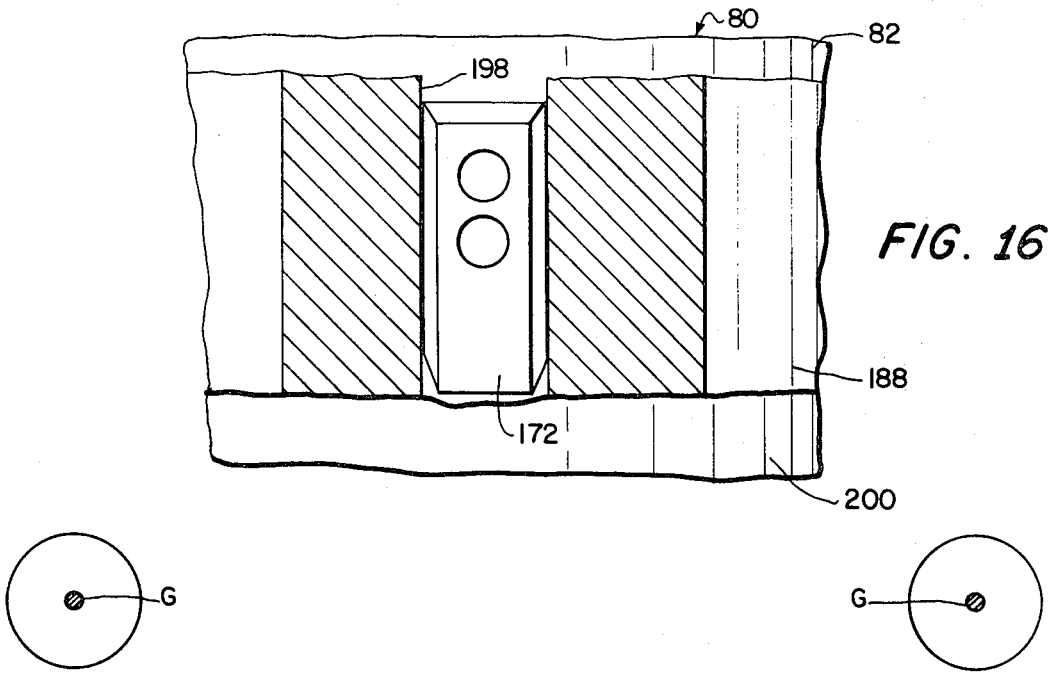
FIG. 16 is an enlarged fragmentary side elevational view, with parts broken away for clarity, of a locator key employed in the apparatus.

While the components just described are installed conventionally, further operations are carried out employing a composite handling joint 10, FIGS. 2–6, a top unit 11, FIG. 15, for the composite joint, a fluid pressure operated multifunction handling tool 12, FIGS. 7–8B, and a multiple string tubing hanger 13, FIGS. 11–14.

Composite Handling Joint

The composite handling joint 10 comprises a heavy wall cylindrical outer pipe 14 to the upper end of which is welded or otherwise rigidly secured a hub 15 of greater wall thickness than pipe 14. A hub 16 is similarly secured to the lower end of pipe 14.

Upper hub 15 has a male threaded connector portion 17 and a bore 18 slightly larger than the inner diameter of pipe 14, the inner end of bore 18 terminating at a transverse annular upwardly facing shoulder 19. A relatively thick closure plate 20 is embraced by the wall of bore 18 and seated on shoulder 19, the plate being secured by arcuate retaining segments 21 secured in an internal groove in hub 15.

Lower hub 16 has a transverse annular outwardly projecting flange 22 which cooperates with inturned flange 23 of a female threaded connector member 24. Internally, hub 16 has a bore 25, terminated at its upper end by shoulder 26, and a closure plate 27 is disposed in bore 25 and secured against shoulder 26 by segments 28 disposed in a transverse inwardly opening groove in the hub. Hub 16 includes a downwardly extending tubular nose portion 29 spaced inwardly from and concentric with the threaded skirt 30 of connector member 24, the outer surface of nose portion 29 being provided with sealing rings 31.

Figures 2, 4, 5, 6:
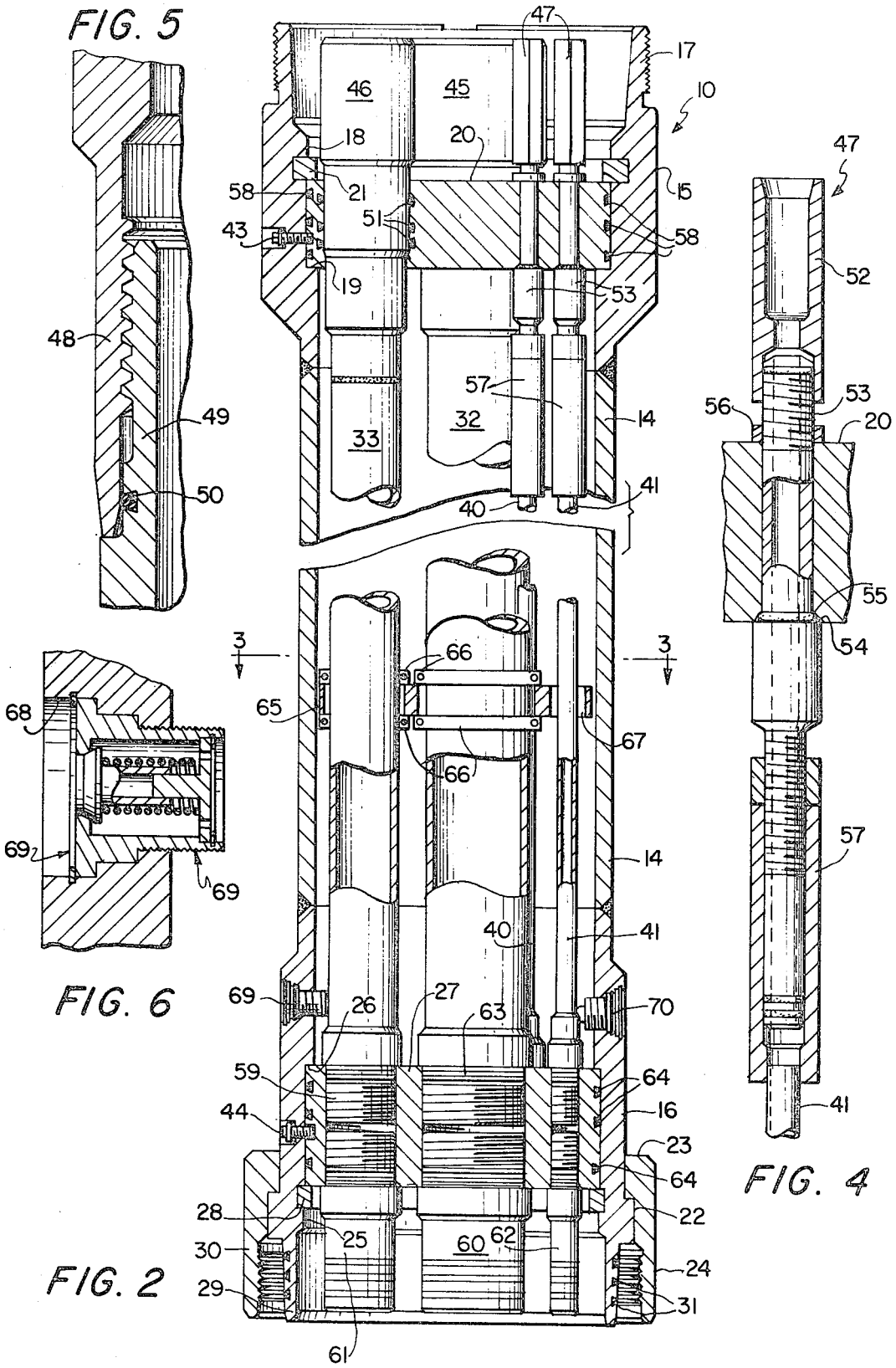
FIG. 2 is a longitudinal sectional view, taken generally on line 2—2, FIG. 3, of the composite handling joint of FIG. 1.
FIG. 4 is an enlarged view, partly in longitudinal section and partly in side elevation, of the upper end portion of one of the pressure fluid conduits employed in the handling joint of FIGS. 1-3.
FIG. 5 is an enlarged fragmentary transverse sectional view illustrating a connection between a pipe and a receptacle forming part of the handling joint of FIGS. 1-3.
FIG. 6 is an enlarged fragmentary sectional view of a check valve assembly employed in the handling joint of FIGS. 1-3.
Figure 3:
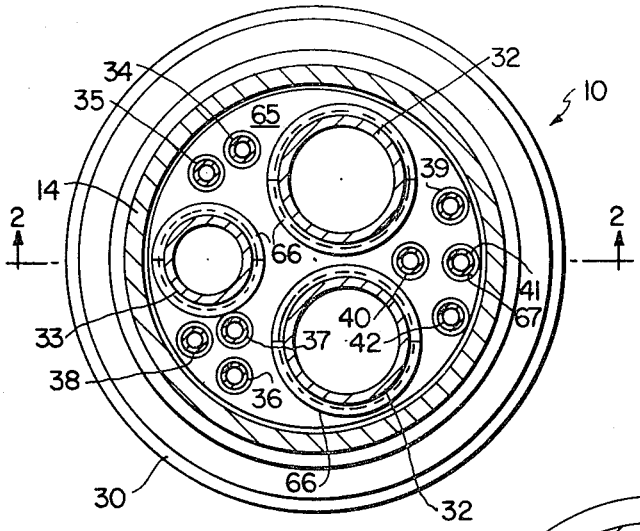
FIG. 3 is a transverse sectional view taken generally on line 3—3, FIG. 2.
Figure 12:
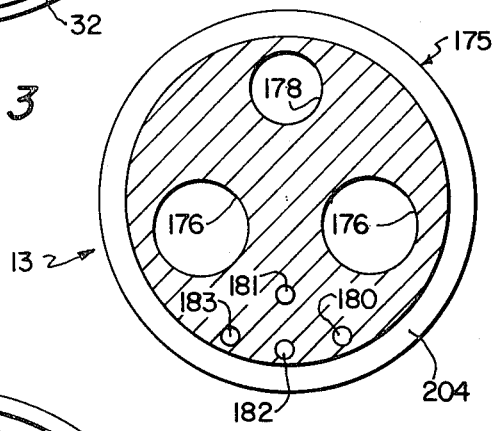
FIG. 12 is a transverse sectional view taken generally on lines 12—12, FIG. 11.

As will be clear from FIGS. 2 and 3, composite joint 10 comprises internal pipes defining a plurality of longitudinal passages through the joint. The inner pipes include two larger pipes 32 to communicate with two tubing strings, a smaller pipe 33 to communicate with the annulus of the well, and nine pressure fluid conduits 34-42. All of pipes and conduits 32-42 extend parallel to the longitudal axis of outer pipe 14 and each pipe or conduit occupies a specific position determined by closure plates 20, 27. Closure plate 20 is secured in a given rotational position by a locator screw 43, FIG. 2, extending through a threaded radial bore in upper hub 15 into a coacting locator socket in the periphery of plate 20. Lower closure plate 27 is similarly secured in a given rotational position by locator screw 44.

Closure plate 20 has bores accommodating two larger receptacles 45, a smaller receptacle 46, and nine still smaller receptacles 47. Receptacles 45 are connected by threaded connections to the upper ends of the respective pipe 32, and receptacle 46 to pipe 33, each in the manner shown in FIG. 5. In each case, the receptacle includes an internally threaded skirt 48, FIG. 5, engaged over an externally threaded pipe end 49, with the joint sealed in fluid-tight fashion by a ring seal 50. The lower portions of receptacles 45, 46 extend within through bores in plate 20 and are sealed by ring seals 51 carried in grooves in the bore walls. Each receptacle 47, as best seen in FIG. 4, comprises an upwardly opening receptacle body 52 threadedly secured to the upper end of tubular body 53 passing through a bore in plate 20. Below plate 20, bodies 53 are each enlarged to provide a shoulder 54 coacting with an O-ring 55 to seal between the body and plate 20. Clamping pressure is applied by nuts 56 carried by bodies 5 above plate 20. Since conduits 34-42 are long, the upper ends of the conduits are connected to bodies 53 by slip joints 57 to make manufacturing tolerances less critical. To seal between the periphery of plate 20 and the wall of bore 18, plate 20 is provided with peripheral grooves accommodating dating seal rings 58.

At their lower ends, all of pipes 32, 33 and conduits 34-42 are provided with fittings having male threaded portions, as at 59 for pipe 33, engaged in threaded portions of corresponding bores in plate 27. The same bores similarly accommodate the male threaded upper end portions of dependent stingers 60 for pipes 32, stinger 61 for pipe 33, and nine stingers 62 for the respective conduits 34-42, suitable seals, as at 63, being provided between plate 27 and each stinger. To seal between the periphery of plate 27 and the wall of bore 25, the plate is provided with peripheral grooves accommodating seal rings 64.

At spaced locations along the length of the composite joint, pipes 32, 33 are secured together by plates 65 and ring clamps 66, as seen in FIG. 2. Plates 65 are of slightly smaller siameter than the inner wall of outer pipe 14 and include openings, as at 67, accommodating but not directly embracing the conduits 34-42. Thus, while plates 65 serve to stabilize the pipe bundle, they still allow longitudinal fluid flow in the space between the pipe bundle and the outer pipe.

Comparing FIGS. 1 and 2, it will be observed that the lower blowout preventers 6, when actuated, will close upon outer pipe 14 of composite joint 10 in a location spaced substantially above the lower hub 16 of the composite joint. Well below that location, and advantageously near the upper end of hub 16, the composite joint is provided with a lateral port 68, FIG. 6, accommodating a check valve 69 which is spring biased outwardly to closed position and can be urged inwardly to open, allowing fluid to flow from outside composite joint 10 into the internal space defined by pipe 14, hubs 15, 16 and closure plates 20 and 27, in response to high external pressures. In similar locations, the composite joint is equipped with at least one port normally closed by a conventional check valve 70 which can be constructed generally as seen in FIG. 6 but arranged to open to allow fluid to flow out of joint 10 only in response to presence of a pressure within the composite joint in excess of the external pressure by a predetermined differential value.

Multifunction Handling Tool

Tool 12 comprises a body member 80 having a right cylindrical outer surface including a portion 81 of smaller diameter and a lower end portion 82 of larger diameter, portions 81 and 82 being joined by a transverse annular upwardly facing shoulder 83. Body 80 has a flat top face 84 and is recessed at its bottom end to provide a flat bottom face 85 surrounded by a dependent peripheral flange 86, faces 84, 85 being at right angles to the longitudinal axis of the tool. Over a substantial upper portion of the length of surface portion 81, body 80 is embraced by a sleeve 87 which is rigidly secured to the body. In this embodiment, body 80 is provided with an outwardly opening groove 88, sleeve 87 has an upwardly facing shoulder 89, and the sleeve is secured by arcuate shear segments 90 seated in groove 88 but projecting outwardly to engage over shoulder 89. Segments 90 are held in place by a spacer ring 91 having an inwardly directed upper flange 92 extending over the segments, the spacer ring being secured by a snap ring 93 engaged in a transverse annular inwardly opening groove in sleeve 87. Below shoulder 89, sleeve 87 has an inner transverse groove accommodating a seal ring 94 to seal between the body and the sleeve.

The upper end portion of sleeve 87 projects beyond end face 84 and includes a portion 95 of reduced outer diameter, portion 95 being externally threaded and so dimensioned that its external threads can cooperate with the internal threads of portion 30, FIG. 2, of the female connector member 24 at the lower end of composite handling joint 10. When the connector comprising portions 30 and 95 is made up, the inner face of portion 95 embraces the outer face of portion 29 so that seal rings 31 form a fluid-tight seal between portions 29 and 95.

Body 80 includes two larger diameter through bores 96, a receptacle 97 being threaded into the upper end of each bore 96 in the manner seen in FIGS. 7 and 8, and the lower end of each bore 96 accommodating a dependent stinger 98 held in place by a retainer plate 99 which is bolted or otherwise secured in engagement with bottom face 85. Body 80 includes a third through bore 100, FIG. 8A, corresponding in size to pipe 33 of the composite joint, and the upper end portion of bore 100 accommodates a receptacle 101, FIG. 8. The lower end of bore 100 accommodates a stinger 102, FIG. 8B, held in place by plate 99. Body 80 further comprises five small pressure fluid bores 103-107, FIG. 8A, which open through top face 84 and extend downwardly to terminate within the body and communicate with lateral bores later described. Body 80 is still further provided with four small through bores 108-111. At top end face 84, each of bores 103-111 accommodates a receptacle 112. At lower end face 85, each of bores 108-111 accommodates a dependent stinger 113, FIG. 8B.

For a considerable distance below shoulder 89, sleeve 87 is of substantial thickness and is provided with a rectangular recess 114 the long axis of which is vertical, the recess opening radially outwardly and slidably accommodating a locator key 115 dimensioned to coact with slot 4*a*, FIG. 17. Diametrically opposite recess 114, sleeve 87 has a window 116 snugly embracing a torque key 117 which is seated in a matching recess in body 80 and is secured rigidly to the body, as by screws 118. Below recesses 114, 116, sleeve 87 presents a first reduced diameter outer surface portion 119 terminating at its upper end in a transverse annular downwardly facing shoulder 120. Below surface portion 119 the sleeve has a second reduced diameter outer surface portion 121 joined at its upper end to surface portion 119 by a transverse annular downwardly facing shoulder 122. The lower end of sleeve 87 constitutes a downwardly facing shoulder at 123.

Below shoulder 120, body 80 is embraced by a movable sleeve 124 having an upper end portion slidably embracing surface portion 119, an inwardly directed transverse annular flange 125 slidably embracing surface portion 121, an intermediate portion presenting a right cylindrical inner surface 126 spaced outwardly from body surface portions 81, 82, and a dependent skirt 127 spaced outwardly from surface 126. Sleeve 124 coacts with body 80 and fixed sleeve 87 to define an annular cylinder an upper portion of which is the space between surface 121 and 126 and a lower portion of which is the space between surfaces 81 and 126. Immediately below shoulder 123, the annular cylinder is closed by a stationary ring 128 clamped between shoulder 123 and a snap ring 129 carried by a groove in body 80. An annular piston 130 is slidably disposed in the lower end portion of the cylinder and includes a dependent skirt 131 slidably embracing the upper end portion of surface 82, skirt 131 joining the body of piston 130 at a downwardly facing shoulder 132 opposed to shoulder 83. Between fixed ring 128 and piston 130, the annular cylinder slidably accommodates a second annular piston 133.

Flange 125 is provided with transverse inner grooves accommodating seal rings 134. Fixed ring 128 has external grooves accommodating seal rings 135 and internal grooves accommodating seal rings 136. Piston 130 has external grooves accommodating seal rings 137 and internal grooves accommodating seal rings 138. Piston 133 has an external groove accommodating seal ring 139 and an internal groove for seal ring 140. Immediately below shoulder 83, surface 82 has an outer groove accommodating seal ring 141.

Figure 7A:
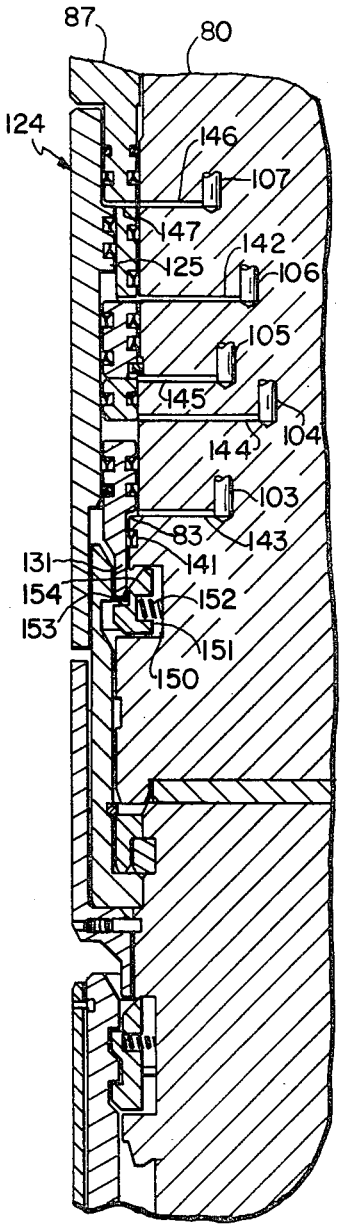
FIGS. 7A-7C are fragmentary longitudinal sectional views, with internal flow ducts shown diagrammatically, of the multipuprose tool of FIG. 7 showing parts of the tool in different operative positions.
Figure 7B:
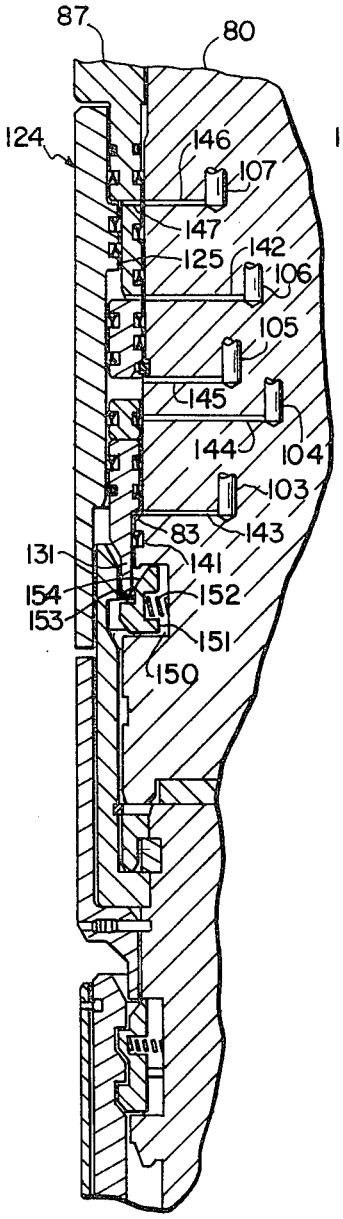
Figure 7C:
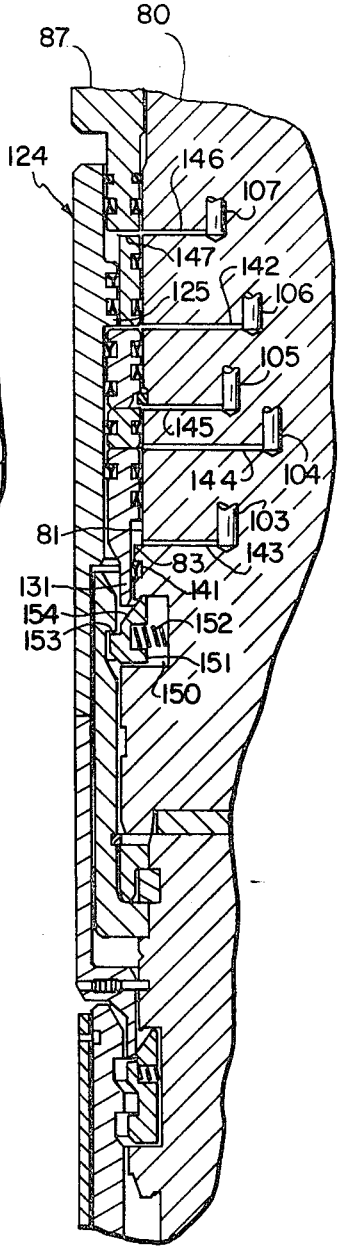

As seen in FIG. 7, the bottom end of bore 106 communicates with a lateral bore 142 which opens outwardly through surface 81 immediately above fixed ring 128, shoulder 123 being grooved to allow pressure fluid to flow from bore 142 into the space defined by the lower end of flange 125, inner surface 126 of sleeve 124, outer surface 121 of sleeve 87, and the upper end face of fixed ring 128. With pressure fluid thus applied, sleeve 124 is driven to the upper position seen in FIG. 7. FIG. 7 being taken on line 7—7, FIG. 8, only bore 106 of the five pressure fluid bores 103-107 appears in that figure, but all five bores are shown diagrammatically in FIGS. 7A-7C. As seen in FIGS. 7A-7C, the bottom end of bore 103 communicates with lateral bore 143 which opens outwardly through surface 81 immediately above shoulder 83. Bore 104 similarly communicates with a lateral bore 144 which opens through surface 81 in a location spaced below fixed ring 128 by a distance equal to the axial length of piston 133, while bore 105 communicates with a lateral port 145 opening outwardly through surface 81 at the bottom end face of fixed ring 128. Bore 107 communicates with a lateral port 146 which opens through surface 81 in the same transverse plane as shoulder 122 so as to communicate with a lateral duct 147, FIG. 7A, through sleeve 87 and thus communicates with the portion of the annular cylinder between shoulder 122 and the upper end of flange 125.

The lower end portion of body 80 has a transverse annular outwardly opening groove 150 in which are disposed a plurality of arcuate latch segments 151 arranged in a circular series. Segments 151 can be of the general type disclosed in U.S. Pat. No. 3,171,674, issued Mar. 2, 1967, to Bickel et al. Thus, each segment is biased outwardly by a spring 152 and has an upwardly facing latch shoulder 153 and an upwardly and inwardly tapering camming surface 154 which is disposed below skirt 131 of piston 130 when the segment is in its outer position.

Figures 9, 10:
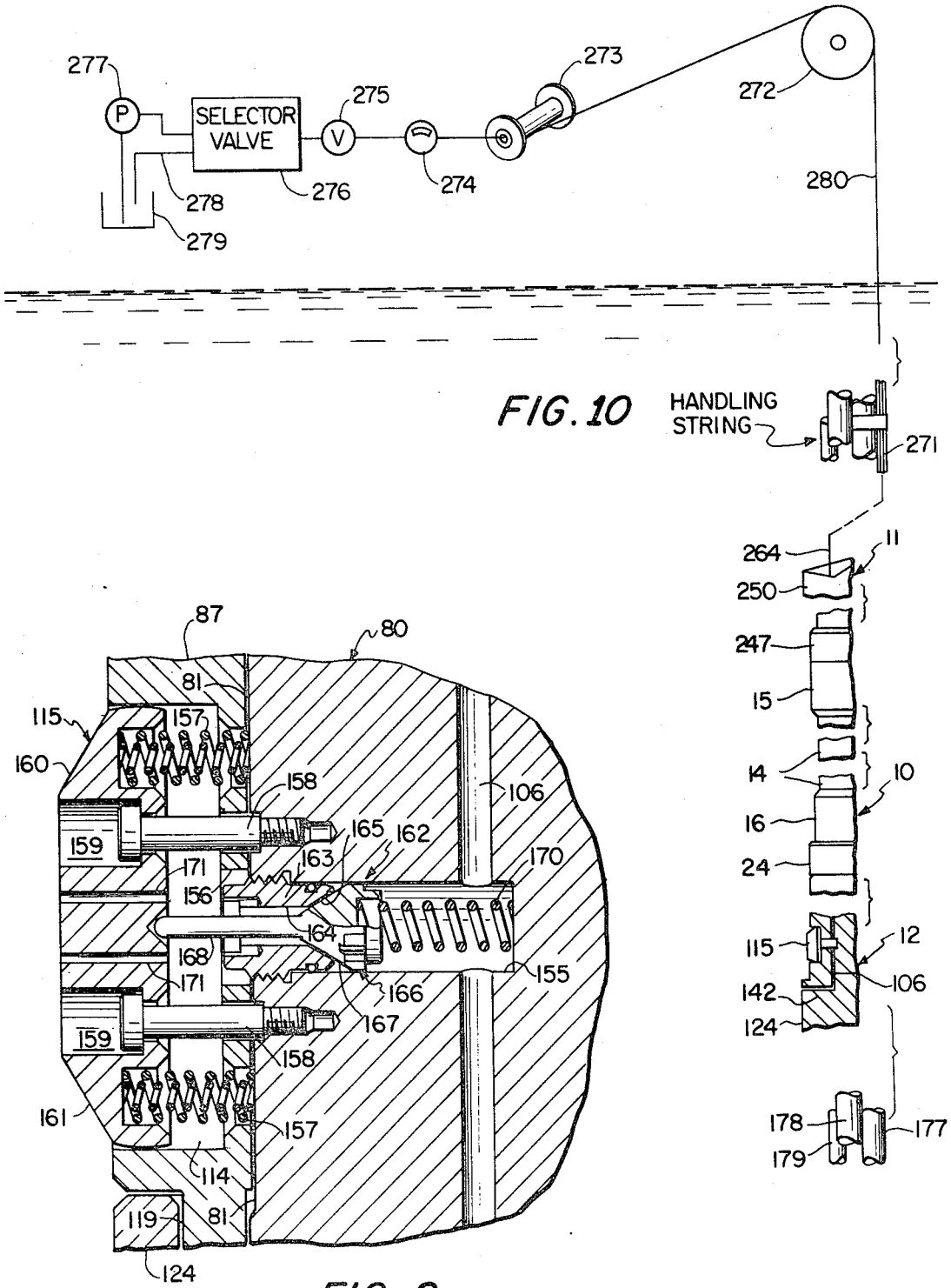
FIG. 9 is an enlarged fragmentary longitudinal sectional view of a combined locator key and position responsive valve forming part of the handling tool of FIGS. 7 and 8.
FIG. 10 is a semidiagrammatic view of the hydraulic circuit for the handling tool of FIGS. 7 and 8.
Figure 11:
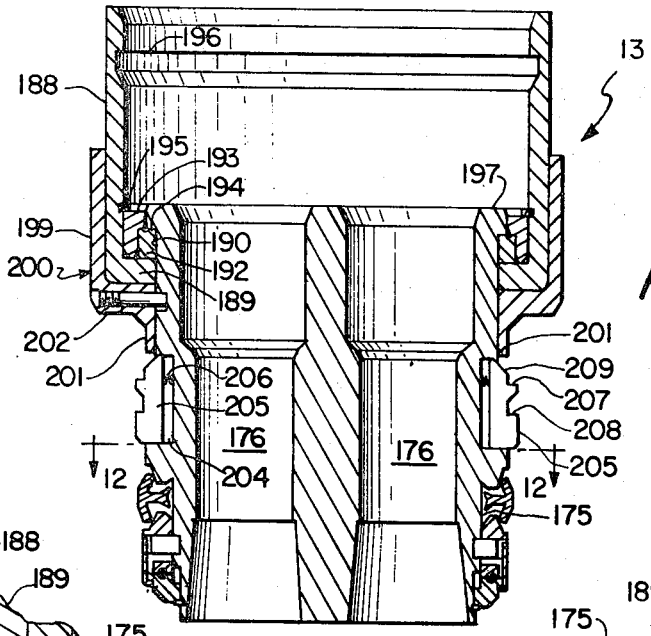
FIG. 11 is a longitudinal sectional view taken generally on line 11—11, FIG. 12, of the multiple string tubing hanger employed in the apparatus.

As best seen in FIG. 9, body 80 is provided with a radial bore 155 having an inner blind end portion interrupting bore 106 so that bore 106 communicates with bores 142 and 155 in parallel. Bore 155 is cylindrical and opens outwardly through surface 81 in a location centered on recess 114 in the assembled tool, and the inner wall of recess 114 has an opening 156 concentric with bore 155. Key 115 has two inwardly opening sockets which accommodate the outer ends of two helical compression springs 157, the inner end portions of the springs extending through openings in the inner wall of recess 114 and bearing on surface 81 of body 80, as shown in FIG. 9. Two guide screws 158 are provided, the inner threaded ends of the screws being engaged in threaded bores in body 80, the heads of the screws being disposed in sockets 159 in the face of locator key 115, the unthreaded shanks of the screws extending freely through openings in the body of the key. Thus, springs 157 urge key 115 to an outer position, seen in FIGS. 7 and 17, determined by engagement of the key with the heads of screws 158, but the key can be forced into recess 114 against the biasing action of springs 157. Key 115 has at its upper end an inwardly and upwardly slanting cam face 160 and, at its lower end, an inwardly and downwardly slanting cam face 161 to coact with the respective ends of slot 4*a* and with any shoulders which may be encountered.

The outer end portion of bore 155 accommodates a check valve indicated generally at 162 and comprising an externally threaded body 163 having an axial through bore 164 and, at the inner end of the body, a frustoconical valve seat 165. Cooperating with body 163 is a movable valve member having a head 166 which presents a frustoconical surface 167 capable of flush engagement with seat 165. The movable valve member also includes a rod 168 which projects axially from the small end of surface 167 and extends through bore 164 in body 163 into engagement in a socket at the center of the inner face of locator key 115. The movable valve member is urged toward body 163 by a compression spring 170 engaged between the blind end of bore 155 and the opposing end of head 166. Bore 164 is of significantly larger diameter than rod 168. A plurality of through bores 171 are provided in key 115 to allow fluid to flow outwardly from recess 114. The effective length of rod 168 is such that, when the key 115 is in its outermost position, surface 167 engages seat 165 under the force of spring 170 and the valve is closed but, when key 115 is forced inwardly into recess 114, rod 168 moves surface 167 inwardly away from seat 165 and the valve is open so that fluid can flow from bore 106 into bore 155, through the space between bore 169 and rod 168, into recess 114 and thence outwardly via bores 171.

At its lower end, body 80 is equipped with a rigidly attached torque key 172.

Tubing Hanger

Tubing hanger 13, FIGS. 11-14, comprises a hanger body 175 having two through bores 176, the upper end portions of bores 176 being enlarged to accommodate the stingers 98 of the multifunction tool 12, the lower end portions of bores 176 being threaded for connection respectively to the uppermost joints 177 of two tubing strings which depend from the tubing hanger and are equipped with conventional downhole safety valves (not shown). Body 175 also has through bore 178 which, at its upper end, accommodates stinger 102 of tool 12 and at its lower end is threadedly connected to the uppermost joint 179 of a third string of tubing depending from the hanger. Four additional bores 180-183, FIG. 12, extend through body 175, being equipped at their upper ends with receptacles to receive stingers 113 and being connected at their lower ends to conduits 184-187, respectively, which extend downwardly in the well from the tubing hanger to the downhole safety valves.

Hanger 13 is connected to multifunction tool 12 by means including a tubular connector member 188 provided at its lower end with an inturned flange 189 slidably embracing body 175. Above flange 189, body 175 has an outwardly opening transverse annular groove 190 accommodating a plurality of segments 192 which project outwardly from the groove to engage over flange 189. The latch segments are retained by a keeper ring 193 fitted between the segments and the wall of member 188 and provided with an upper inturned flange 194 engaged over the tops of the portions of segments 192 which project outwardly from groove 190. Member 188 has an internal groove accommodating a snap ring 195 engaging the upper end of keeper ring 193 to complete the rigid connection between member 188 and body 175.

The inner diameter of member 188 is such that member 188 can be slidably engaged over surface portion 82 of the body of the multifunction tool 12. Member 188 has a transverse annular inwardly opening latch groove 196 of such shape and location as to be capable of receiving the latch segments 151 of tool 12 when upper end face 197 of body 175 is engaged with the lower end face of portion 86 of tool body 80. Thus, when member 188 is fully telescoped over the lower end of body 80 of tool 12 and piston 130 is in its raised position, latch segments 152 snap outwardly into the groove 196 under the action of springs 152 so that the tubing hanger is latched to the multifunction tool in the manner shown in FIG. 7. Member 188 has an inwardly opening longitudinal inner groove 198 which accommodates the outwardly projecting portion of key 172 so that rotational forces applied to tubing hanger 13 via the handling string and tool 12 are applied directly from body 80 to member 188 via key 172, such forces then being applied directly to body 175 via elements 189, 195, 193 and 192.

When hanger 13 is secured to tool 12, dependent skirt 127 of sleeve 124 embraces the upper portion of member 188. The lower portion of member 188 is embraced by the upper portion 199 of a latch retracting sleeve 200. Lower portion 201 of sleeve 200 is of smaller diameter and slidably embraces body 175, portions 199 and 201 being joined by a transverse annular wall 202 underlying flange 189 of member 188 and being of adequate thickness to accommodate a shear screw 203 engaged in a recess in body 175 to retain the latch retracting sleeve in its upper, inactive position.

Below the lower tip of portion 201 of the latch retracting sleeve, body 175 has a transverse annular outwardly opening groove 204 accommodating an annular series of arcuate latch segments 205 which are biased outwardly by springs 206. Each segment 205 has two vertically spaced upwardly facing latch shoulders 207, 208 and an upwardly and inwardly slanting camming surface 209. As best seen in FIG. 13, the upper wall of groove 204 has a dependent outer lip 210 as a stop engaged by the upper end of surfaces 209 when the segments are urged to their outermost positions by springs 206. When, as seen in FIG. 14, segments 205 are in outer positions, camming surfaces 209 are exposed to be engaged by the tip of skirt 201. Latch segments 205 are dimensioned to be received by latch grooves 211, 212 in the inner surface of the upper member 213, FIGS. 13 and 14, of casing hanger packoff device 3, FIG. 17.

Below groove 204, body 175 is of reduced outer diameter, providing a cylindrical outer surface portion 214 embraced by a seal device, indicated generally at 215, of the general type described in U.S. Pat. No. 3,268,241, issued Aug. 23, 1966, to Castor et al. Surface portion 214 terminates at its upper end in an annular downwardly tapering nose portion defined by an inner frustoconical surface 216 which slants downwardly and outwardly, an intermediate flat transverse surface 217, an outer frustoconical surface 218 which slants downwardly and inwardly, and an outer flat transverse shoulder 219. Spaced below surface 217, a ring 220 slidably embraces surface portion 214 of body 175, being releasably secured to body 175 by a plurality of shear pins 221. Ring 220 presents an annular upwardly tapering nose portion defined by an inner frustoconical surface 222 which slants upwardly and outwardly, an intermediate flat transverse surface 223, an outer frustoconical surface 224 which slants upwardly and inwardly, and an outer flat transverse shoulder 225. The space between the two nose portions is occupied by a resiliently compressible sealing ring 226 having upper and lower surfaces conforming approximately to the two nose portions but so dimensioned as to accommodate a substantial movement of ring 220 upwardly on body 175 before the seal ring is compressed significantly.

At its lower end, ring 220 includes a dependent outer tubular flange 227 encircling a flat end face 228. The upper race member 229 of an antifrication ball bearing 230 is embraced by flange 227 and seated against face 228. Bear 230 includes a lower race member 231 having a downwardly and inwardly tapering frustoconical load-bearing shoulder 232 capable of flush engagement with a support shoulder 233 presented by member 213 of packoff device 3. The lower end portion of body 175 is of still further reduced outer diameter so as to present surface portion 234 which terminates at its upper end in a transverse annular shoulder 235. While the inner diameter of the upper portion of race member 231 is sized to slidably embrace surface portion 214 of body 175, the race member includes an inturned flange 236 at its lower end which slidably embraces the smaller outer surface portion 234 of body 175 and presents an upwardly facing shoulder 237 which is opposed to but spaced below shoulder 235 when ring 220 is retained in its initial position by shear pins 221. The bearing is completed by an outer tubular shell 238 which has an inturned flange at its lower end engaged beneath a cooperating shoulder on lower race member 231, an O-ring being provided within the shell to seal between the lower race member and the lower edge of flange 227, as shown in FIGS. 13 and 14. Lower race member 231 is retained by a snap ring 239 secured in an outwardly opening groove at the lower end of body 175.

Considering FIG. 13, it will be noted that, when shear pins 221 are intact and shoulder 232 is engaged with shoulder 233, two conditions are maintained which promote maximum freedom of rotation for body 175 relative to lower race member 231 and shoulder 233. The first condition is that sealing ring 226 is essentially uncompressed because of the relatively large axial space between surfaces 216-219 of body 175, on the one hand, and surfaces 223-225 of ring 220, on the other hand. Hence, sealing ring 226 causes little frictional resistance to rotation of the tubing hanger. The second condition is that latch segments 205 are not engaged with any latching groove, being still too high to mate with grooves 211 and 212, and are in only rubbing engagement, under action of springs 206, with the main cylindrical inner wall olf member 213. Shear pins 221 are so selected that, e.g., 20% of the total weight of the string of pipes can be supported through ring 220 and bearing 230 without shearing the pins. Accordingly, as later described, the tubing hanger can be landed and then rotated, with, e.g., 80% of the weight supported from the operational base via the handling string. When the desired rotational position has been achieved, more or all of the weight of the string of pipes can be applied, with the result that pins 221 are sheared. Body 175 then descends until shoulder 235 engages shoulder 237. As seen in FIG. 14, such downwardly movement of body 175 brings latch segments 205 into mating relation with grooves 211, 212 and also fully compresses sealing ring 226 to effectively seal between body 175 and member 213. It will be noted that, when body 175 reaches the position seen in FIG. 14, the weight of the pipe strings depending from hanger 13 is supported on shoulder 233 through race member 231 and body 175, shoulders 230, 237 being in metal-to-metal contact, and the antifriction bearing being by-passed so far as support of the load is concerned.

Top Unit for Composite Handling Joint

From FIG. 2, it will be apparent that a plurality of the composite joints 10 can be interconnected to form the entire handling string, when desired. Advantageously, only a single composite joint 10 is used, in which case the upper end of the composite joint is closed by top unit 11, FIG. 15. Top unit 11 comprises a short length of heavy wall pipe 245 having outer shoulder 246 coacting with a female threaded coupling member 247 identical to member 24, FIG. 2. Internally, pipe 245 has a transverse annular downwardly directed shoulder 248 against which is seated a closure plate 249 retained by snap ring 249*a*. Rigidly secured to the upper end of pipe 245, as by welding, is a cylindrical closure body 250 provided with through bores disposed to be coaxially aligned with the respective receptacles 45-47 presented at the top of composite joint 10. Of these through bores, bore 251 is typical of those to be aligned with the two receptacles 45 and receptacle 46. At its lower end, bore 251 includes a threaded portion to accept the threaded upper end 252 of a stinger 253. Below such threaded engagement with the stinger, bore 251 includes a cylindrical portion to accommodate an unthreaded portion 254 of the stinger, portion 254 being equipped with seal rings at 255. Stinger 253 extends through an opening 256 in plate 249 and has a transverse annular shoulder 257 engaged with the bottom face of plate 249. Lower end portion 258 of stinger 253 is dimensioned for downward insertion into receptacle 46 of the composite joint 10 and is equipped with seal rings 259 to seal between the stinger and receptacle. The upper end portion of bore 251 is threaded, as at 260, to receive the threaded lower end of a pup joint 261 of the same internal diameter as pipe 33, FIG. 2. Save for dimensions, the bores and stringers to cooperate with the two receptacles 45 of composite joint 10 are identical to those just described.

Body 250 is also provided with nine plain through bores 262 so located that, when top unit 11 is connected to the upper end of composite joint 10 by cooperation of member 247 with male thread portion 17, FIG. 2, each bore 262 is coaxial with a different one of the nine receptacles 47. Closure plate 249 has through bores corresponding respectively to bores 262 and accommodating the stingers 263 to cooperate with receptacles 47. Conduits 264 extend upwardly from stingers 263 and through the respective bores 262. Above body 250, conduits 264 grouped into a composite bundle to extend beside and be strapped to one of the larger pipes which serves as the handling string by which the combination of composite joint 10 and top unit 11 is manipulated.

Installation of Tubing Hanger

Figure 3A:
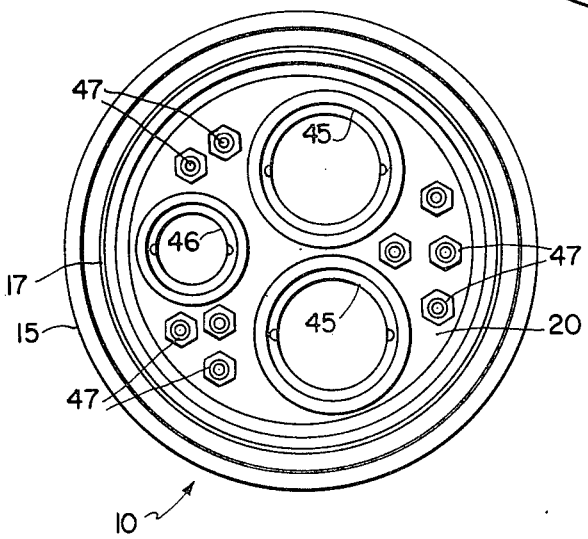
FIG. 3A is a top plan view of the composite handling joint of FIG. 1.

Working at the operational base at the water surface, handling tool 12 is connected to composite handling joint 10. With composite joint 10 upright, screw plugs 270, FIG. 3A, are removed from corresponding bores in closure plate 20 and the composite joint 10 is completely filled with water, using one bore for filling and the other to vent air from the interior space of joint 10, care being taken to remove substantially all air from joint 10. Plugs 270 are replaced and top unit 11 then connected to joint 10. The pup joints for the two larger handling pipes are installed on unit 11. Tubing hanger 13 is connected to tool 12 and bores 103 and 106 are pressurized to assure that pistons 130, 133 and sleeve 124 are in their upper positions, pressure being maintained in bore 103 until the tubing hanger has been landed. The tubing strings comprising joints 177-179, FIG. 17, and the downhole safety valve conduits 184-187 are made up to the tubing hanger. Using the conventional guidance system, the combination of composite joint 10, handling tool 12 and hanger 13 is positioned rotationally so that locator key 115 of handling tool 12 is so located relative to guide lines G, FIG. 18, as to be displaced, e.g., 30° counterclockwise from the location of locator slot 4*a*, FIG. 17, in the wellhead upper body 4. The nine independent flexible tubes of a composite hose 271, FIG. 10, are then connected respectively to the upper ends of the conduits 264, composite hose 271 being strapped to one of the handling string pipes and extending upwardly over a sheave 272 and thence to a storage reel 273 where a length of the hose adequate to extend from the operational base to the wellhead is stored. Each tube of hose 271 is connected via a swivel joint (not shown) of the reel 273 to the series combination of a pressure indicating gauge 274, an on-off valve 274 and a selector valve 276. Valve 276 is a conventional valve operative to selectively connect certain of the tubes of composite hose 271, and thus selected ones of the conduits 264, to the output of a pump 277, while another related tube is connected, as the return, to a pipe 278 leading to the supply 279 from which pump 277 draws hydraulic fluid.

At this stage, sleeve 124 and annular pistons 130 and 133 of tool 12 are in their uppermost positions, seen in FIG. 7, and latch segments 151 and 205 are therefore urged outwardly by their respective biasing springs. Locator key 115 is biased outwardly by its springs 157, FIG. 9, so that valve 162 is closed, and with hydraulic fluid supplied by pump 277 via tube 280, FIG. 10, the one of ducts 264 communicating with conduit 37 and bore 106 will be applied, without loss, via lateral duct 142, FIG. 7, to the portion of the annular cylinder between flange 125 of sleeve 124 and fixed ring 128, so full hydraulic pressure will appear in that portion of the annular cylinder and will be indicated by gauge 274.

Using a conventional derrick, draw works and motion compensators, the handling string is now made up and lowered to run the composite handling joint 10, tool 12 and hanger 13 to the wellhead and through the blowout preventers until shoulder 232 of the hanger lands on shoulder 233 of packoff device 3. The major part, e.g., 80% of the total weight of the tubing and handling strings is supported at the operational base, so that only 20% is supported through shoulders 232, 233 and shear pins 221 therefore remain intact.

As tool 12 enters the blowout preventer stack, locator key 115 is cammed inwardly by the surrounding bore wall and remains in an inward position, so that valve 162 is open as tool 12 enters wellhead upper body 4, since the rotational position of tool 12 was selected at the outset so that key 115 was displaced from locator slot 4*a*. With valve 162 open, hydraulic fluid supplied from pump 277 via tube 280, conduits 264 and 37, and bores 106 and 142 is allowed to escape via valve 162 and bores 171, so a marked reduction in pressure is shown by gauge 274, indicating that locator key 115 is not seated.

When shoulders 232, 233 are engaged, the handling string is rotated clockwise in order to bring locator key 115 of tool 12 into registry with slot 4*a*, and the key snaps outwardly into the slot. Engagement of key 115 in slot 4*a* provides two indications of the occurrence, both observable at the operational base. The first indication is the usual abrupt resistance to further turning of the handling string. The second indication is the return of gauge 274 to full pressure indication, occurring because, as key 115 moves radially outwardly into groove 4*a*, valve 162 is closed under the infuence of its spring 170. The second indication corroborates the first, proving that the locator key 115 has in fact engaged in slot 4*a*.

Engagement of key 115 in slot *4a* secures tool 12, and therefore hanger 13, at that rotational orientation predetermined for the hanger, so that the orientation of the bores 176, 178 and 180-183 through the hanger body 175 relative to the guidance system is known. With key 115 engaged in slot *4a*, the full weight of the string is now applied to the tubing hanger by relieving the strain on the handling string. As a result, shear pins 221 are sheared, and body 175 of hanger 13 descends to the position seen in FIG. 14, so that latch segments 205 engage in grooves 211, 212 to latch the tubing hanger in place and the full weight of the tubing strings is removed from bearing 230, being now supported by direct engagement of shoulder 235, 237. During the transition from the FIG. 13 position to that in FIG. 14, there can be no relative rotational shifting between handling tool 12 and hanger 13 since the stingers of the tool are engaged in the receptacles of the hanger and torque key 172 is engaged in slot 198.

With tubing hanger 13 successfully landed, oriented, and latched to packoff device 3, handling tool 12 can be remotely disconnected from the tubing hanger by operating selector valve 276 to pressurize the tubing of composite hose 271 which communicates with bores 104, 144 of tool 12, bores 143, 103 then acting to vent. As seen in FIG. 7A, pressurization of bores 104, 144 drives piston 130 downwardly, so the skirt 131 comes into engagement with camming surfaces 154 of latch segments 151 and cams the latch segments inwardly into groove 150 to such an extent that the tips of the latch segments are disengaged from groove 196 of connector member 188. Tool 12 is now free for upward withdrawal.

Should pressurization of bores 104, 144 be unsuccessful in unlatching tool 12 from hanger 13, a secondary means is provided for that purpose. Thus, selector valve 276 can be operated to pressurize bores 105, 145 of tool 12 and supply pressure to the space between secondary piston 133 and fixed ring 128, so that the combination of pistons 133, 130 is therefore driven downwardly to cause skirt 131 to retract latch segments 151 as seen in FIG. 7B.

What is claimed is:

1. A well apparatus of the type comprising an outer annular support structure presenting an upwardly facing support shoulder, a well tool to be landed on the support shoulder, and coacting locator means for retaining the well tool in a predetermined rotational position, the combination of antifriction bearing means comprising
- an annular upper bearing race member,
- an annular lower bearing race member having a downwardly facing shoulder adapted to engage the upwardly facing support shoulder, and
- antifriction bearing elements engaged between said race members,
- said upper race member embracing a first upright cylindrical surface presented by the well tool; and means including a shear member disposed to resist downward movement of the well tool relative to the upper race member;

the well tool having a second upright cylindrical surface located below said first surface and joined to said first surface by a transverse annular downwardly facing shoulder, said lower race member having an inwardly directed transverse annular flange embracing said second surface and presenting an upwardly facing shoulder opposed to said downwardly facing shoulder;

the well tool being supported by the support shoulder of the outer structure and by said bearing means when said shear member is intact, and then being free to be rotated relative to the outer structure, application of increased downward force to the well tool being effective to shear said shear member and cause said second upright surface to move downwardly through the lower race member until said upwardly facing shoulder of the flange of the lower race member is engaged with said downwardly facing shoulder and the well tool is no longer supported via said antifriction elements.

2. The combination defined in claim 1, wherein the well tool has an outer shoulder spaced above the upper race member, the combination further comprising a deformable seal ring encircling the well tool in the space between said outer shoulder and the upper race member, the deformable seal ring having dimensions such that the seal ring is not substantially deformed when the shear member is intact but is deformed into sealing engagement between the outer support structure and the well tool when the upwardly facing shoulder of the flange of the lower race member engages the downwardly facing shoulder of the well tool.

3. The combination defined in claim 2 and further comprising a seal energizing ring encircling said first upright cylindrical surface of the well tool above the upper race member, said shear member being engaged with the well tool and said seal energizing ring, the lower race member engaging said seal energizing ring, said outer shoulder of the well tool and said seal energizing ring having opposed nose portions adapted to engage and deform the seal ring when, after the shear member has been sheared, the well tool is moved downwardly through the antifriction bearing means to bring the upwardly facing shoulder of the flange of the lower race member into engagement with said downwardly facing shoulder.

4. In a multiple string tubing hanger, the combination a hanger body member having an upper portion presenting a first cylindrical outer surface portion, an intermediate portion presenting a second cylindrical outer surface portion of smaller diameter than said first surface portion, said first and second portions being joined by a transverse annular shoulder presenting an annular downwardly directed seal-energizing surface, and a lower portion presenting a third cylindrical outer surface portion of smaller diameter than said second surface portion, said second and third surface portions being joined by a transverse annular downwardly directed support shoulder;

a ring member slidably embracing said second surface portion and presenting an annular upwardly directed seal-energizing surface opposed to said downwardly directed seal-energizing surface of the body member, said ring member also having a flat annular bottom face, and a tubular depending outer skirt surrounding said bottom face;

shear means releasably securing said ring member to the body member in a first position in which said seal-energizing surfaces are spaced apart by a predetermined distance;

a resiliently deformable sealing ring encircling said second surface portion between said seal-energizing surfaces, the width of said sealing ring when in relaxed undeformed condition being such that said sealing ring is not substantially deformed when said ring member is in said first position; and antifriction bearing means comprising an annular upper race member embraced by said depending skirt and engaged with said bottom face of said ring member, an annular lower race member comprising an upper portion having an inner diameter such as to slidably embrace said second surface portion, a lower inwardly projecting flange having an inner diameter such as to slidably embrace said third surface portion, and a transverse annular downwardly directed shoulder adapted to be landed on an internal support shoulder of the member on which the tubing hanger is to be landed, antifriction elements operatively engaged between said race members, and means engaged with said lower race member and retaining the same in operative position relative to the upper race member;

said inwardly projecting flange of the lower race member having an upper face which is spaced below said downwardly directed support shoulder of the body member when said ring member is in said first position;

said shear means being capable of being sheared when a predetermined downwardly acting force is applied to the body member while the downwardly directed shoulder of the lower race member is engaged with a supporting shoulder, the body means then being moved downwardly through the ring member and bearing means until said downwardly directed support shoulder of the body member engages the upper face of said flange of the lower race member, such downward movement of the body member relative to the ring member causing the sealing ring to be resiliently deformed between said seal-energizing surfaces but the body member then being supported by metal-to-metal contact between the lower race member and the support shoulder on which it has been landed and metal-to-metal contact between the upper face of the flange of the lower race member and the downwardly directed support shoulder of the body member.

* * * * *